US005211199A

United States Patent [19]

Seidel et al.

[11] Patent Number: 5,211,199

[45] Date of Patent: May 18, 1993

[54] SELF-OPENING TOPLESS POCKET UMBRELLA

[75] Inventors: Joachim Seidel, Solingen; Klaus Stiller, Langenfeld, both of Fed. Rep. of Germany

[73] Assignee: Kortenbach Verwaltungs-Und Beteiligungs Gesellschaft/mbH & Co., Fed. Rep. of Germany

[21] Appl. No.: 616,567

[22] Filed: Nov. 21, 1990

[30] Foreign Application Priority Data

Jun. 29, 1990 [DE] Fed. Rep. of Germany ..... 4020679

[51] Int. Cl.[5] ..... A45B 25/14

[52] U.S. Cl. ..... 135/24; 135/25.2; 135/25.3

[58] Field of Search ..... 135/24, 25.2, 25.3–25.34, 135/22

[56] References Cited

U.S. PATENT DOCUMENTS

| | | | |
|---|---|---|---|
| 616,307 | 12/1898 | Fleisch | 135/24 |
| 829,858 | 8/1906 | Eaton | 135/25.33 X |
| 1,839,309 | 1/1932 | Gundel | 135/25.2 |
| 2,076,525 | 4/1937 | Bouma | 135/25.2 |
| 3,746,025 | 7/1973 | Murata | 135/22 |
| 3,756,258 | 9/1973 | Yoshihara | 135/24 X |
| 3,853,136 | 12/1974 | Schwartzenberg | 135/25.2 |
| 3,856,030 | 12/1974 | Sato | 135/24 X |
| 4,149,553 | 4/1979 | Lee | 135/24 |
| 4,534,374 | 8/1985 | Day | 135/24 X |
| 4,548,222 | 10/1985 | Day | 135/24 |
| 4,627,455 | 12/1986 | Okuda et al. | 135/25.3 |
| 4,683,617 | 7/1987 | Schultes et al. | 135/22 X |
| 5,020,558 | 6/1991 | Huang | 135/24 |
| 5,036,872 | 8/1991 | Huang | 135/24 X |

FOREIGN PATENT DOCUMENTS

| | | | |
|---|---|---|---|
| 1716 | 1/1884 | United Kingdom | 135/24 |

*Primary Examiner*—Carl D. Friedman
*Assistant Examiner*—Lan M. Mai
*Attorney, Agent, or Firm*—Samuel Meerkreebs

[57] ABSTRACT

The invention relates to a self-opening topless pocket umbrella having a telescopic stick and a collapsible canopy framework arranged radially on the stick in the form of scissor-link folding systems which can be spread out by means of an opening spring and collapsed manually by a slider which is displaceable on the telescopic stick, the respective scissor-link folding system each having a pair of scissor levers, of which an upper scissor lever is linked to the umbrella crown, while the lower scissor lever engages the slider in an articulated manner. In order to make the opening mechanism smoother and to protect the umbrella stick from being scratched as well as, moreover, to design the closed umbrella to be thinner in its cross-section and more pocket-sized, the invention provides that two arms (K', K'') of the respective scissor levers (4, 5), together with an intermediate strut (14) arranged between them, form a double lever triangle (D', D''), the intermediate strut (14) engaging at one end on an intermediate crown (C''), which is fixed non-displaceably to the end (1*a*) of the stick, and engaging at the other end on, or directly adjacent to, the scissor lever cross-joint (6), and that the crown (C') with the joint (7) of the upper scissor lever (4) carries out a free stroke in relation to the intermediate crown (C'') when the canopy is opened under the effect of the opening spring (F) stressed between the crown and the telescopic stick (1).

8 Claims, 2 Drawing Sheets

SELF-OPENING TOPLESS POCKET UMBRELLA

BACKGROUND OF THE INVENTION

1. Field of the Invention

The invention relates generally to a self-opening pocket umbrella of the topless type, i.e. in which the cover is not directly supported by the canopy framework immediately around the top of the stick.

These umbrellas are of the type having a telescopic stick and a collapsible canopy framework extending radially from the stick in the form of scissor-link folding systems which can be spread by means of an opening spring and collapsed manually by a slider which is displaceable along the stick. Each scissor-link folding system having a pair of scissor levers, of which an upper one of the scissor levers is pivotally linked to a main crown, while the lower one of the scissor levers is pivotally connected to the slider. Such an umbrella is hereinafter referred to as of the kind described.

2. Description of Related Art

Umbrellas of this kind are known, for example, from U.S. Pat. No. 4,682,617. As a result of the scissor-operated folding kinematics of the canopy framework, they are stable in their design and very user-friendly since they can be opened and closed in one movement by the operation of the slider, involving simultaneous, automatic folding up of the canopy cover. In contrast, it is disadvantageous that the opening spring stressed between the slider and an associated auxiliary slider in the known frames of this type, and their encapsulation take up appreciable space between the telescopic stick and the canopy framework so that the known umbrellas of this type become relatively thick in cross-section in the closed state. Additionally, the opening spring in this design rubs up and down over virtually the entire length of the stick when the umbrella is opened and closed with the result that wear-scratches on the stick cannot be avoided.

Moreover, this arrangement and function of the opening spring, together with the tensioning and sliding mechanism between the auxiliary and main sliders moving the lever scissors, requires a relatively large spring force and thus also a great manual effort upon closing, making the closing movement somewhat difficult.

SUMMARY OF THE INVENTION

The underlying object of the invention is to improve a self-opening umbrella of the kind described having a scissor folding linkage in such a way that it can be operated with minimal strength or less effort and can be closed in a more user-friendly manner and, additionally, has a more pocketsized, thinner (smaller) cross-sectional volume in the closed state.

According to the invention, in an umbrella of the kind described, the radially inner arms of the respective scissor levers together with an intermediate strut located between them, form two triangular linkages; the intermediate strut engaging at its radially inner end an intermediate crown, which is fixed non-displaceably to the upper end of the stick, and engaging at its radially outer end on or adjacent to a scissor lever cross-joint, and wherein the main crown with its joint to the upper scissor lever can move freely away from the intermediate crown when the canopy framework is opened under the effect of the opening spring which acts between the main crown and the stick.

A particularly advantageous embodiment of the invention results if the intermediate strut, in the opened position of the umbrella canopy, extends substantially at right angles to the stick axis with simultaneous formation of a right-angled triangular formation of the two triangular linkages.

An optimally short structure of the folded umbrella can be achieved if, according to a further advantageous development of the invention, the opening spring in the stressed state is completely sunk in the stick and the crown rests on the end of the stick or on the intermediate crown.

According to this design it is also particularly advantageous if, according to a further development of the invention, the opening spring is encapsulated in a slide sleeve guided in the end of the stick.

Another advantageous development of the invention permits a still further shortening of the folded shortened umbrella if the crown with a ring linking the upper scissor levers, is inverted in the manner of a cup over the end of the stick or the intermediate crown.

By these means, a self-opening pocket umbrella of optimum user-friendliness having a scissor-operable folding mechanism is provided. The double lever triangular linkages between the two inner "power" arms of the scissor levers, the lifting mechanism of the upper lever triangular linkage in conjunction with the opener spring engaging on the main crown above the intermediate strut, and the displacing mechanism of the lower lever triangular linkage below the intermediate strut allows a particularly balanced, power-saving spreading out and collapsing of the canopy linkage. The manual pulling forces to be applied according to this design, when closing the umbrella by means of the slider, are considerably reduced compared to the known self-opening pocket umbrellas having scissor lever folding kinematics, because the opener force can be equal to the spring force according to this design. Additionally, the opener spring need no longer rub on the stick so that the latter is saved from unsightly scratches and abrasion marks. Since the opener spring also no longer necessarily winds around the stick, it also no longer enlarges its cross-section or it also no longer requires installation space between the stick and the canopy linkage with the result that the folded umbrella has a thinner, more pocket-sized cross-sectional structure.

The invention is explained in greater detail below by way of example with reference to the accompanying drawings, in which.

Figure 1:
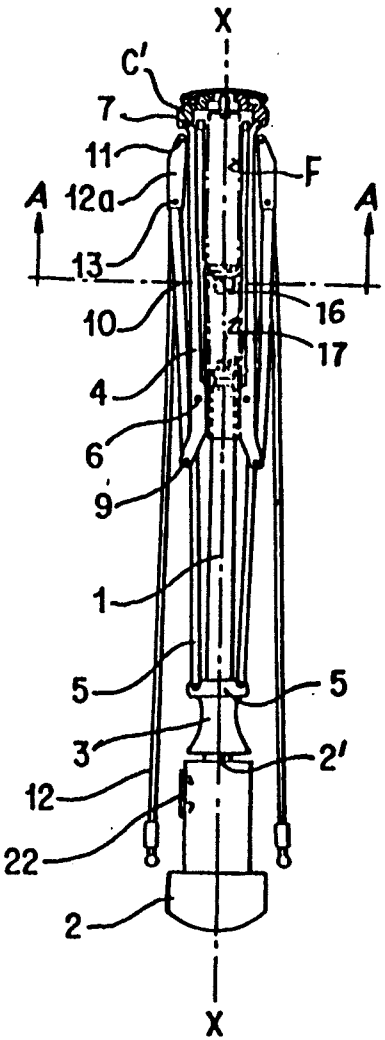
FIG. 1 is an elevational view of a pocket umbrella frame in a "closed" or collapsed or folded condition, partly in section, with the umbrella cover removed.
Figures 3, 4:
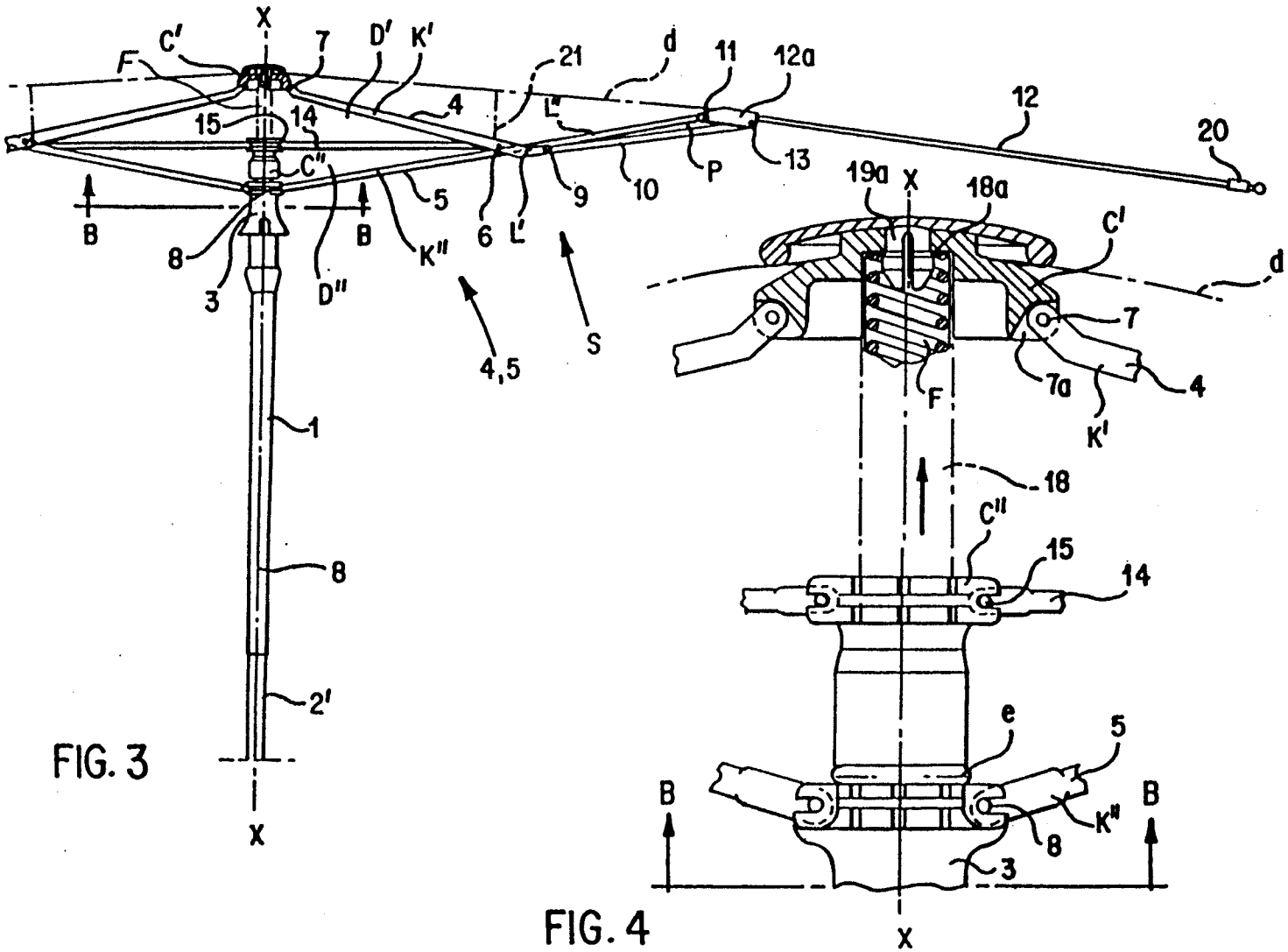
FIG. 3 is an elevational view of the "open" or errected pocket umbrella frame, showing the umbrella cover in phantom line, with the lower handle "2" not shown.
FIG. 4 is an enlarged elevational view, taken above line B—B of FIG. 3.

The umbrella according to the invention is a self-opening pocket umbrella of the so-called topless design having scissor link kinematics and a canopy cover not directly supported in the region of the canopy near to the stick, but which is stretched in a suspended manner. Such umbrellas have the advantage that the opening and closing of the canopy, including the folding of the canopy cover, takes place in one movement. In the self-opening design, the user, as is conventional, initiates opening by depressing a button. The umbrella has a telescopic stick 1 consisting, of at least two parts, including a handle 2 to the lower end, and an intermediate crown C″ fixed firmly at the top to the end 1*a* of the stick, see U.S. Pat. No. 4,682,617, mentioned above. Between the intermediate crown and the handle 2, a slider 3 is displaceable up and down on the telescopic stick 1; as seen in FIGS. 1 & 3. The collapsible canopy linkage consists of several folding systems S, grouped radially around the telescopic stick 1, of which systems only one to the left and one to the right of the telescopic stick 1 is illustrated, in each case, for purposes of clarity. Each folding system has, in each case, a pair of scissor links on the stick side having a two-arm upper scissor lever 4 and a two-arm lower scissor lever 5 and a cross-joint 6 connecting these two levers. The upper scissor lever 4 is connected in a swivelling manner by its "power" arm K′ via a joint 7 to the umbrella crown C′, while the lower scissor lever 5 engages on the slider 3 with its "power" arm K″ via a joint 8; see FIG. 4.

The scissor lever 4 is connected in a swivelling manner to a control rod 10 by an angled "load" arm L′ via a joint 9, while the lower scissor lever 5 engages on an outer canopy rod 12 with its "load" arm L″ via a joint 11. The control rod 10 is linked to the outer canopy rod 12 from a joint 13. The two load arms L′ and L″ of the scissor levers 4 and 5, the control rod 10 and the short lever arm 12*a* of the outer canopy rod 12 form a parallelogram linkage P which is operable from the scissors 4, 5, 6 and which, in turn, operates the outer canopy rod 12.

Arranged between the two power arms K′ and K″ of the scissor levers 4 and 5 is an intermediate strut 14 which is linked at one end to an intermediate crown C″ via a joint 15 and is mounted in a pivotal manner at the other end on the cross-joint 6 of the scissor levers 4, 5, or adjacent to the cross-joint on one of the two levers. In this manner, the two arms K′ and K″ in conjunction with the intermediate strut 14, and the linking of these parts at the stick axis X, form double triangular linkages D′ and D″. In this case, the intermediate strut 14 forms a common central longitudinal side of this double linkage. Since, as a result of the rigid attachment of the intermediate crown C″, the intermediate strut 14 is mounted non-displaceably on the intermediate crown, only the two scissor links 4 and 5 are displaced upwards and downwards on both sides of the intermediate crown C″ when the canopy is opened and closed. In this case, the umbrella crown C′, with the upper scissor levers 4 linked to it, carries out a lifting movement on the stick axis X in relation to the end 1*a* of the stick or to the intermediate crown C″, since this crown C′ is supported flexibly and freely suspended in relation to the telescopic stick 1 and the intermediate crown C″ by the opening spring F serving for automatic canopy opening. Accordingly, the power arm K′ of the upper scissor lever 4, being spring-supported, and the arm K″ of the lower scissor lever 5 each oscillate to one side (above and below, respectively) of the nondisplaceable intermediate strut 14, so that the latter also forms a horizontal beam (or base) between the two triangular linkages D′ and D″. Owing to this formation, in particular in a rightangled or virtually right-angled alignment of the intermediate strut 14 relatively to the stick axis X, a particularly advantageous balance, i.e. counterbalancing results in the lever proportions in such a way that the opening force is equal to the spring force. By this means, the pulling, i.e. closing, forces are also correspondingly minimized so that the umbrella can be pulled closed smoothly by means of the slider 3 against the spring force and, additionally, the canopy linkage can assume the maximum stretched opening position shown with the linkage lying close together in the central region. Owing to the maximum stretching, an optimally large canopy parabola results, that is to say, an optimum canopy usage surface.

In addition to the balance of the lever forces, the opening and spring force and the minimization of the pulling, closing, forces, there is also the further advantage that, as a result of its suspension arrangement at the umbrella tip, the opening spring F no longer requires any accommodation space on the umbrella stick 1. Abrasion marks and scratches on the latter are therefore likewise avoided and, additionally, the umbrella can then also still be folded to form a slimmer, more pocket-sized, small-volume structure.

Figure 2:
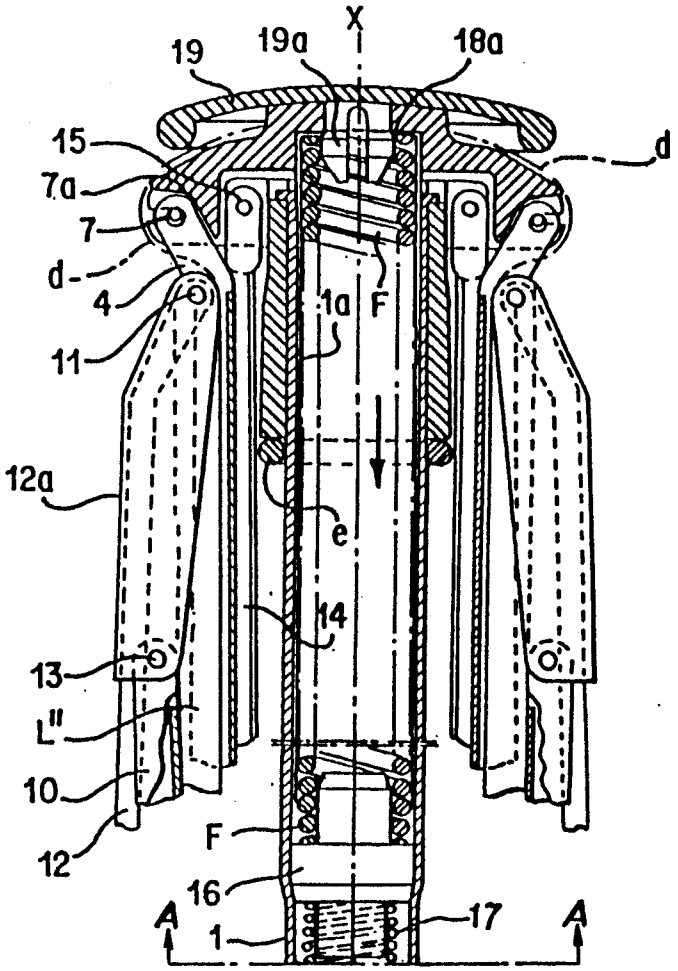
FIG. 2 is an enlarged fragmentary elevational view, taken substantially on the longitudinal axis x—x and above line A—A of FIG. 1.

In its stressed state, the opening spring F is preferably sunk into the telescopic stick 1 for its full length; see FIG. 2, so that the umbrella crown C′ can rest on the end 1*a* of the stick or on the intermediate crown C″ against the spring force when the canopy is closed in order in this way to achieve a substantial shortening of the closed umbrella. An even more substantial shortening can be achieved if the umbrella crown C′ is inverted with a cup-shaped linking ring 7*a* and the joints 7 seated on the latter over the intermediate crown C″ and the joints 15 when the umbrella is shortened so that the joints 7 and 15 do not come to rest one over the other but adjacently whilst utilizing the corresponding shortening length.

According to this design, the canopy linkage also receives an optimally narrow, slim folding possibility. Firstly, the intermediate struts 14 rest closely on the telescopic stick 1. On them lie the upper scissor levers 4 and the load arms L″ of the lower scissor levers 5 fold into their outwardly facing hollow profiles. Directly on them lie the control rods 10, which, in turn, receive the outer canopy rods 12 in a hollow profile. However, the control rods 10 can also be folded in with an inwardly facing hollow profile in a meshing manner over the arms L″ and can be immersed together with the latter into the hollow profiles of the scissor levers 4, the outer canopy rods 12 then resting closely on this meshed formation.

The opening spring F can be tensioned between a stopper 16 seated in the telescopic stick and the umbrella crown C′, it being possible for the stopper 16 to serve simultaneously as a support stop of a spring 17 automatically pushing out the telescopic stick 1 when the umbrella is opened. To avoid corrosion, the opening spring F can be encapsulated by means of a slide sleeve 18 which is sunk with the opening spring F in the end la of the stick and is guided displaceably therein. In this case, the slide sleeve 18 with an insertion opening 18*a* at the end can form a detachable anchorage for the catch 19*a* of a top cap 19 fastening the canopy cover d centrally. Besides this, the canopy cover d is also tacked onto the peripheral ends 20 of the outer canopy rods 12 and fixed by means of threads 21 to the upper scissor levers 4. In this manner, the canopy cover d is also folded in one movement when the canopy is closed. The automatic opening of the canopy by the opening, spring F and, if appropriate, the automatic stick telescoping of stick arts 1, 2′, can take place by pressing the triggering button 22 situated on the grip 2 in conjunction with a suitable mechanism previously mentioned U.S. Pat. No. 4,682,617. An elastic ring e seated on the telescopic stick 1 below the intermediate crown C″ damps the stop of the slider 3 at the end of the canopy opening movement.

We claim:

1. In a self-opening, topless umbrella having a telescopic stick and a collapsible framework extending radially from the stick, said framework comprising a plurality of circumferentially-shaped, scissor-link folding systems operable to be spread by means of an upwardly-opening spring(F) and collapsed manually, by a slider(3) which is displacable along said stick, each scissor-link folding system comprising a pair of intermediately-pivoted(6) scissor levers(4,5), said stick having an upper end and a lower end, an operating spring(F) supported on the upper end of said stick, a main crown(C′) resting on and freely supported on the upper end of said spring, an upper one of (K′) of said scissor levers comprising an upper power lever and being pivotally connected(7) to said main crown(C′) and movable therewith as the umbrella frame is opened and closed, a lower one(K″) of said scissor levers comprising a lower power lever and being pivotally connected(8) to said slider(3) and movable therewith as the umbrella frame is opened and closed, an intermediate crown(C″) fixed adjacent the upper end of said stick and the lower end of said operating spring, and a control strut(14) pivoted at an inner end to said intermediate crown(C″) and pivoted at an outer end adjacent the pivot(6) of said scissor levers whereby said scissor-link folding systems are guided, when opening and closing, by said control strut(14).

2. The structure as claimed in claim 1 in which the intermediate strut, in the open position of said framework, extends substantially right angles to said stick and forms right-angled triangular formations(D′,D″) when said power levers(K′,K″)

3. The structure as claimed in claim 1 in which said operating spring (F) is supported on the upper end of said stick and extends intermediately of said intermediate crown(C″).

4. The structure as claimed in claim 2 in which said operating spring (F) extends into the upper end of said stick and is compressed between said stick and main crown(C′) when the framework is closed.

5. The structure as claimed in claim 1 in which said spring is enclosed within a sleeve guided on the upper end of said stick and which is displacably engaged by said main crown.

6. The structure as claimed in claim 2 in which said spring is enclosed within a sleeve guided on the upper end of said stick and which is displacably engaged by said main crown.

7. An umbrella according to claim 1, wherein the main crown includes a ring pivotally connected to the upper power levers and comprises an inverted cup depending over the upper end of the stick adjacent intermediate crown when the framework is closed.

8. An umbrella incorporating a frame according to any one of the preceding claims, including a cover supported by the canopy frame work.

* * * * *

UNITED STATES PATENT AND TRADEMARK OFFICE

CERTIFICATE OF CORRECTION

PATENT NO. : 5,211,199

DATED : May 18, 1993

INVENTOR(S) : Joachim Seidel and Klaus Stiller

It is certified that error appears in the above-identified patent and that said Letters Patent is hereby corrected as shown below:

Column 6, claim 2, line 4, change "when" to--with--.

Signed and Sealed this

Fourteenth Day of December, 1993

Bruce Lehman

*Attest:*

BRUCE LEHMAN

*Attesting Officer*

*Commissioner of Patents and Trademarks*